US006061828A

United States Patent [19]

Josephs

[11] Patent Number: 6,061,828

[45] Date of Patent: May 16, 2000

[54] CAMOUFLAGE ITEMS AND CAMOUFLAGE MATERIAL THEREON

[76] Inventor: Ira Josephs, 415 Grand St., New York, N.Y. 10002

[21] Appl. No.: 08/822,212

[22] Filed: Mar. 21, 1997

[51] Int. Cl.[7] ..... A41B 1/00

[52] U.S. Cl. ..... 2/69; 2/900; 428/919

[58] Field of Search ..... 2/69, 1, 108, 94, 2/93, 85, 115, 900; 428/919

[56] References Cited

U.S. PATENT DOCUMENTS

| | | |
|---|---|---|
| D. 59,034 | 9/1921 | Ransom et al. . |
| D. 64,173 | 3/1924 | Golding . |
| D. 150,828 | 9/1948 | Craig . |
| D. 297,076 | 8/1988 | Kolpin et al. . |
| D. 297,596 | 9/1988 | Marquart, Sr. . |
| D. 297,786 | 9/1988 | Braungardt . |
| D. 299,188 | 1/1989 | Norton . |
| D. 301,289 | 5/1989 | McIlhinney . |
| D. 301,803 | 6/1989 | McIlhinney . |
| D. 301,804 | 6/1989 | McIlhinney . |
| D. 301,805 | 6/1989 | McIlhinney . |
| D. 306,658 | 3/1990 | Haskell . |
| D. 309,380 | 7/1990 | Barger et al. . |
| D. 324,312 | 3/1992 | Ferguson . |
| D. 326,363 | 5/1992 | Cooper . |
| D. 332,179 | 1/1993 | Barger et al. . |
| D. 363,594 | 10/1995 | Nethken, Jr. . |
| D. 365,192 | 12/1995 | Semaska . |
| D. 366,154 | 1/1996 | Bick et al. . |
| 3,967,026 | 6/1976 | Dalblom . |
| 4,375,448 | 3/1983 | Hogan . |
| 4,656,065 | 4/1987 | Yacovella . |
| 4,868,019 | 9/1989 | Knickerbocker . |
| 5,203,033 | 4/1993 | Sheppard, Sr. et al. . |
| 5,445,863 | 8/1995 | Slagle et al. . |

OTHER PUBLICATIONS

Cabela's—1994 Fall Catalog p. 28,29,296—Trebark pattern & Printed Camo Cordura Bags, Sep. 1994.

*Primary Examiner*—Gloria M. Hale
*Attorney, Agent, or Firm*—Brian Roffe

[57] ABSTRACT

A camouflage garment having a torso portion, sleeves extending downward from a top, side of the torso portion and an optional neck portion. The torso portion, sleeves and optional neck portion are made of a camouflage material having a plurality of rectilinear shapes, adjacent ones of which have a different color. The rectilinear shapes each have at least six straight sides and an interior angle between 180° and 360° and may be formed only by straight sides whereby opposed straight sides are substantially parallel to one another. Camouflage enhancement features may be arranged in connection with the camouflage material for enhancing the camouflage effect of the camouflage material.

20 Claims, 16 Drawing Sheets

CAMOUFLAGE ITEMS AND CAMOUFLAGE MATERIAL THEREON

FIELD OF THE INVENTION

The present invention relates generally to camouflage items having a camouflage pattern thereon, and more particularly to garments, shower curtains, lawn furniture, backpacks and sheet materials having a distinctive camouflage pattern. Certain embodiments of the camouflage pattern in accordance with the invention utilize the principles of disruptive patterning, shading and/OR countershading so that the camouflaged item may blend in with surrounding features.

BACKGROUND OF THE INVENTION

Traditional camouflage material, at least since the advent of World War II, has been formed in patterns of earth-colored splotches on a lighter background, or darker, green-dominated leaf pattern camouflage. These camouflage patterns usually have curved or wavy borders separating the different colors. More recently, imitation bark patterns have been introduced which include shapes resembling barks of trees, i.e., slender, elongated shapes, and these latter patterns have retained much of the splotchiness of the traditional camouflage patterns. However, the previously proposed camouflage materials have not been ideal for hunting in certain forested environments, because their more-or-less traditional camouflage patterns have not mimicked real tree bark sufficiently well, and do not cause the wearer of a garment including the camouflage pattern to resemble or blend with the trunks of surrounding trees.

Many of the bark camouflage patterns available today are almost photographic and are designed to look like a particular type of tree. Consequently, this type of camouflage works only if, when applied to a garment worn by a hunter, the hunter is standing among trees of that particular kind. Other types of bark camouflage are characterized by groupings of lighter tones, which can be easily spotted by the prey. Still others use small or closely connected patterns which can be too tight, and lose definition, becoming discernible masses of color at a distance.

Among prior art patents directed to camouflage garments for hunters and camouflage patterns applied to such garments, reference is made to U.S. Pat. No. 4,656,065 (Yacovella) which describes a bark camouflage cloth which mimics the rough bark of a tree. The camouflage pattern on the cloth contains rough, highly elongated vertical ribs of a first light or countershaded earth tone, vertical channels of a second, darker earth tone, an black vertical shadow edge markings along one side edge of each of the ribs. Islands of a third color, e.g., a greenish hue, are interspersed among the vertical ribs. The pattern of vertical shadow edge markings changes left to right across the pattern to create the illusion of curvature of a tree trunk.

Other utility patents directed to camouflage patterns and camouflage items include U.S. Pat. No. 5,445,863 which describes a three-dimensional camouflage sheet, U.S. Pat. No. 5,203,033 which describes a camouflage garment, U.S. Pat. No. 4,375,488 which describes a two-dimensional camouflage material with spaced apart rows of cuts, and U.S. Pat. No. 4,868,019 which describes a camouflage material with different color hues.

There are numerous design patents directed to camouflage patterns, e.g., U.S. Pat. Nos. Des. 297,076, Des. 297,596, Des. 297,786, Des. 299,188 Des. 301,289, Des. 301,803, Des. 301,804 Des. 301,805, Des. 306,658, Des. 309,380, Des. 324,312, Des. 326,363, Des. 332,179, Des. 363,594, Des. 365,192 and Des. 366,154. The camouflage patterns of most of these design patents include the shape of specific objects, such as animals (U.S. Pat. Nos. Des. 297,786 and Des. 301,804), people (U.S. Pat. Nos. Des. 301,289 and Des. 301,803), trees with leaves (U.S. Pat. Nos. Des. 309,380, Des. 332,179 and Des. 366,154), leaves alone (U.S. Pat. No. Des. 326,363), tree bark (U.S. Pat. No. Des. 324,312), tree branches (U.S. Pat. Nos. Des. 299,188 and Des. 306,658).

OBJECTS AND SUMMARY OF THE INVENTION

It is an object of the invention to provide a new and improved camouflage pattern which, when appropriately colored and shaded, may be used to provide camouflage for an object to which the pattern is applied.

It is another object of the present invention to provide a garment, e.g., for hunters, having a new and improved camouflage pattern.

In order to achieve these objects, and others, the camouflage material in accordance with the invention is configured to provide a shading-based camouflage effect when applied in particular to garments for hunters and other outdoors-people. The material has thereon a camouflage pattern that includes a plurality of rectilinear shapes, adjacent ones of which have a different color. Each rectilinear shape has at least six straight sides and an interior angle between 180° and 360°, and may be formed only by straight sides whereby opposed straight sides are substantially parallel to one another. In certain embodiments, camouflage enhancement means are arranged in connection with the camouflage pattern for enhancing the camouflage effect of the camouflage material. The enhancement means are rectangular shapes arranged within at least one of the rectilinear shapes and having a color different than the rectilinear shape surrounding the same, slender projections extending from edges of at least one of the rectilinear shapes therein or into an adjacent rectilinear shape, rectangular shapes arranged within at least one of the rectilinear shapes and having projections extending from a pair of opposed sides, the rectangular shapes and projections having a color different than the color of the surrounding rectilinear shape, and a branch line structure extending through at least one of the rectilinear shapes and having a color different than the color thereof. The rectilinear shapes may be arranged to form a repeating pattern. In other embodiments, one of the rctilinear shapes constitutes a background of the camouflage cloth and other rectilinear shapes are imposed on that rectilinear shape, have a different color and do not contact each other. This construction may optionally used in connection with the camouflage enhancement means described herein.

By appropriately selecting the shape and colors of the rectilinear shapes and shape and arrangement of the camouflage enhancement means, it is possible to create a beneficial camouflage effect to provide camouflage for hunters when in forested surroundings. It should also recognized that other combinations of colors, patterns and camouflage enhancement means can be created to provide camouflage protection for other uses and/or in other surroundings.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE PREFERRED EMBODIMENTS

Figure 1A:
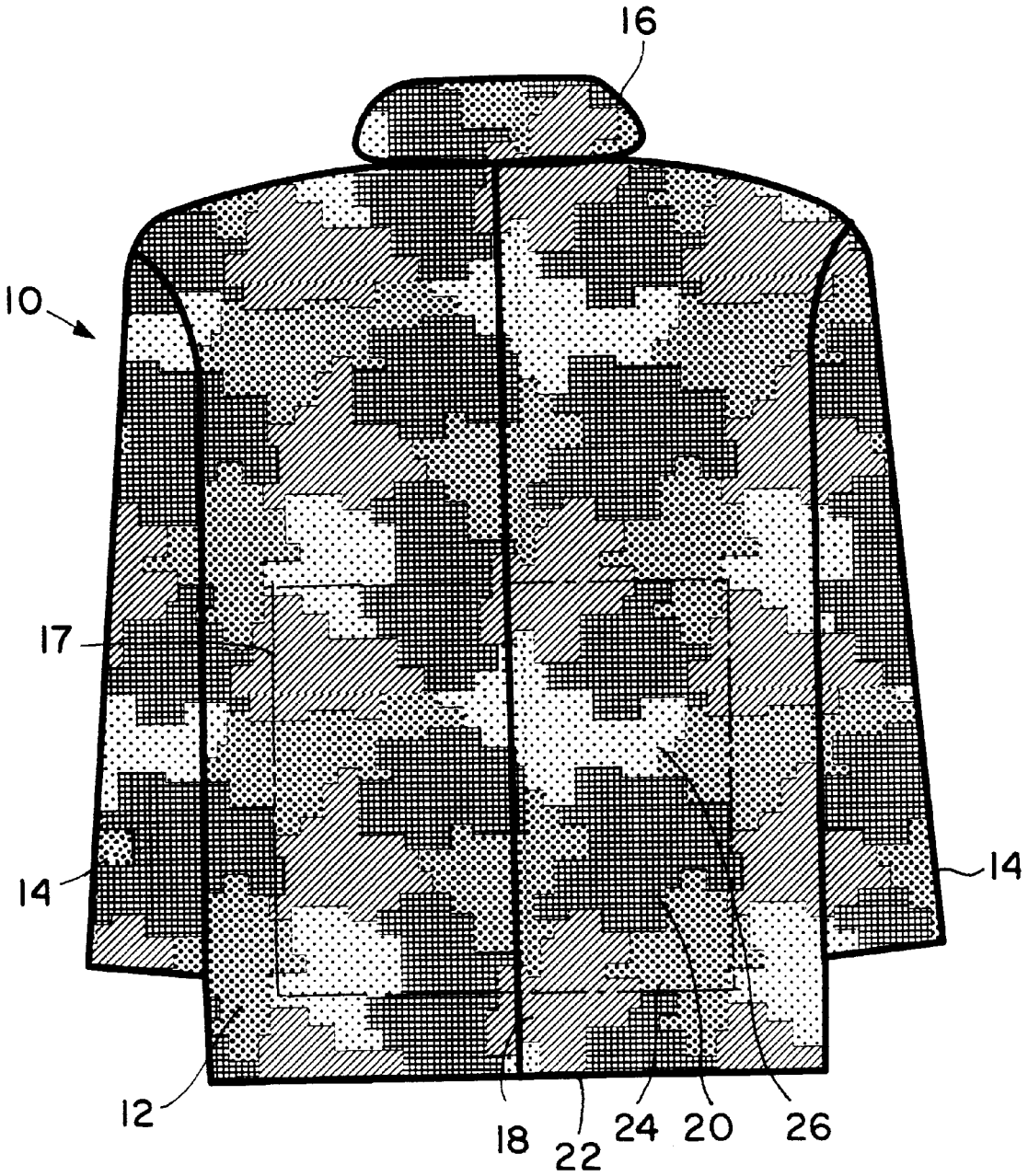
FIG. 1A is a rear view of a garment such as a blouse or jacket made of camouflage material including a repeating pattern according to one embodiment of the invention.

Referring to FIGS. 1–14 wherein like reference numerals refer to the same or similar elements, a camouflage pattern in accordance with the invention as applied to a garment 10 conformed to fit a portion of the human body is shown in FIG. 1A. Garment 10 includes a torso portion 12 including a seam 18, sleeves 14 extending downward from a top, side of the torso portion 12, and a neck portion 16 extending from a top edge of the torso portion 12, all formed of the camouflage material or cloth in accordance with the invention, or at least so that the outer, exposed surface of the torso portion 12, the sleeves 14 and the neck portion 16 is covered by the camouflage material in accordance with the invention since it is only necessary that the outer exposed surface of the garment 10 have the camouflage pattern. Although a rear view of the garment, which may be a blouse or a jacket, is shown in FIG. 1A, the front view of the garment has the same general appearance. Other garments conformed to fit the human body, such as trousers, gloves, head coverings, vests (similar to the jacket shown in FIG. 1A but without sleeves), etc., may also be manufactured so that the outer, exposed surface is covered by the camouflage pattern in accordance with the invention or is otherwise made from the camouflage material in accordance with the invention. It is pointed out at this juncture, that the camouflage material in accordance with the invention may be a sheet of fabric, cloth, plastic, etc., onto which the camouflage pattern is applied, either during the formation of the material sheet or after.

In certain embodiments, the camouflage pattern as shown on the garment 10 in FIG. 1A is printed on a continuous roll or bolt of cloth in a repeating manner, i.e., the actual camouflage pattern is formed from a repeating array 17 (as shown in dotted lines) of a single arrangement of different shapes which is extended to encompass substantially the entire dimensions of the roll or bolt of cloth. Alternatively, the continuous roll or bolt may be made of a non-repeating pattern.

The repeating component 17 of the particular construction of the camouflage pattern as shown on the garment in FIG. 1A comprises a plurality of rectilinear shapes 20,22,24,26. For the purposes of this application, a rectilinear shape will be defined as a closed shape which has straight sides formiing a closed structure, i.e., bounded or formed by straight lines. Preferably, the rectilinear shapes have at least six sides and one or more interior angles greater than 180° and less than 360°. Also, the rectilinear shapes preferably have only straight sides, opposite ones of which are substantially parallel to one another. Adjacent rectilinear shapes have different colors, the specific colors being any color desired. In the illustrated embodiment in FIG. 1A, the rectilinear shapes 20,22,24,26 assume any one of four different colors. It is possible that the repeating pattern will include some shapes which are not rectilinear shapes within the definition of this term set forth above.

As shown in FIG. 1A, rectilinear shape 26 has 28 straight sides, i.e., 14 pairs of opposed, parallel sides. Its interior is a single color. There is no criticality to the exact number of sides in each of the rectilinear shapes 20,22,24,26 in order to provide a camouflage effect, rather, it is the overall pattern of such rectilinear shapes, and essentially the coloring thereof, which provides the desired camouflage effect. Each rectilinear shape 20,22,24,26 has numerous straight sides and each adjacent pair of straight sides in each rectilinear shape are substantially perpendicular to one another.

If the garment to be made from the camouflage material is to resemble traditional camouflage garments, then the colors will be the traditional colors of black, brown, green and beige. However, it should be recognized that the specific colors, as well as the number of different colors in the camouflage pattern, may be determined without limits, although it should also be recognized that certain color schemes might not provide a camouflage function improved over prior art patterns such as tree bark patterns. The colors on the garments may be provided in any known manner, e.g., by dying an underlying material.

Figure 1B:
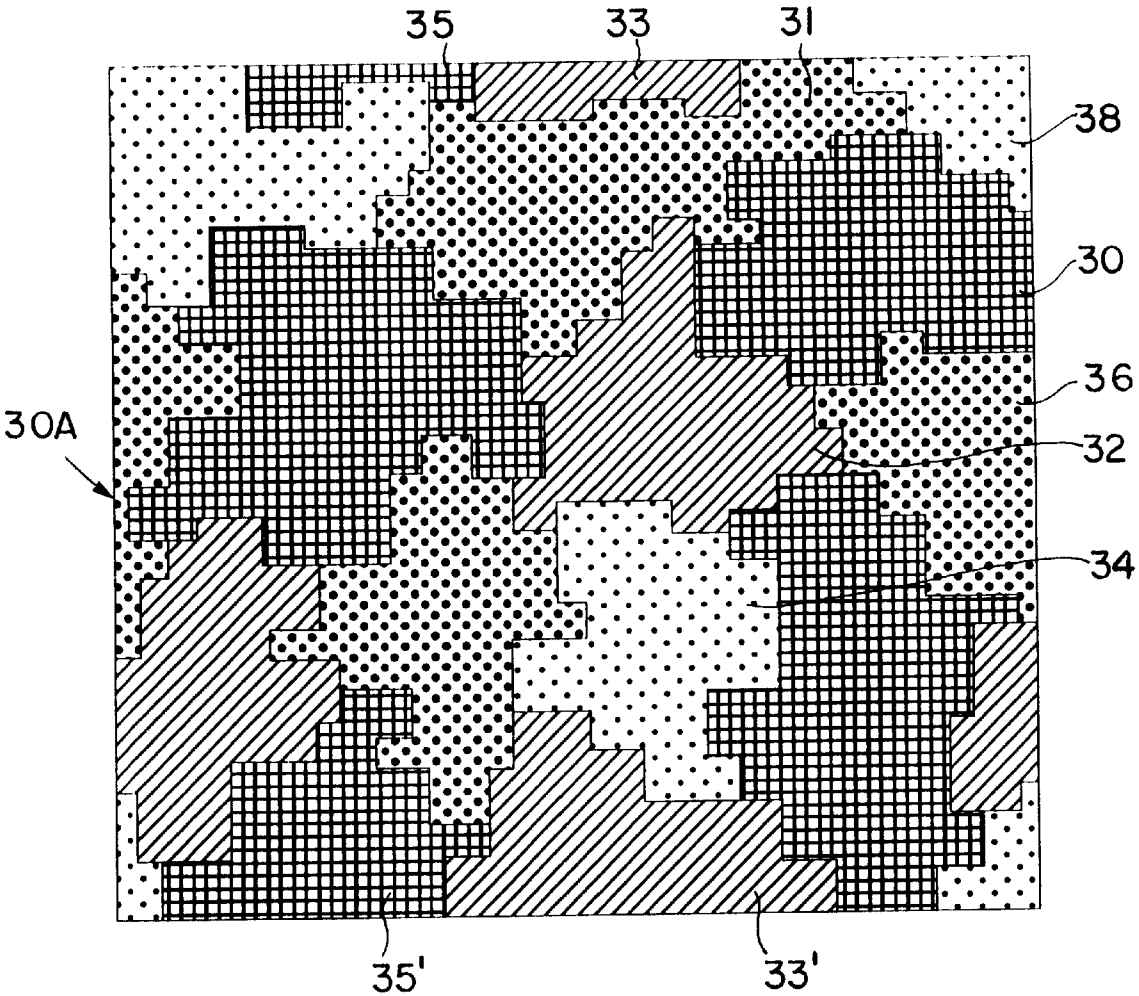
FIG. 1B is a view of a second repeating camouflage pattern for use in conjunction with the garment shown in FIG. 1A.

FIGS. 1B, 2, 3 and 4 all show different variations of the camouflage pattern on the garment shown in FIG. 1A and which may also be applied to the garment shown in FIG. IA. In FIG. 1B, it is pointed out that with respect to rectilinear shape 30 in the repeating pattern 30A, all of the adjacent rectilinear shapes have a different color, i.e., adjacent rectilinear shapes 36 and 38 are one color, rectilinear shapes 31 is another color and rectilinear shape 32 is yet another color. It is also pointed out that rectilinear shapes 33 and 35 at the upper edge of the repeating pattern 30A have the same color as the respective one of the rectilinear shapes 33',35' at the bottom edge of the repeating pattern 30A so that when the repeating pattern 30A is repeated to form, e.g., a garment, a combined rectilinear shape is formed. Rectilinear shape 34 is interposed between rectilinear shapes 32 and 33'.

Figure 2:
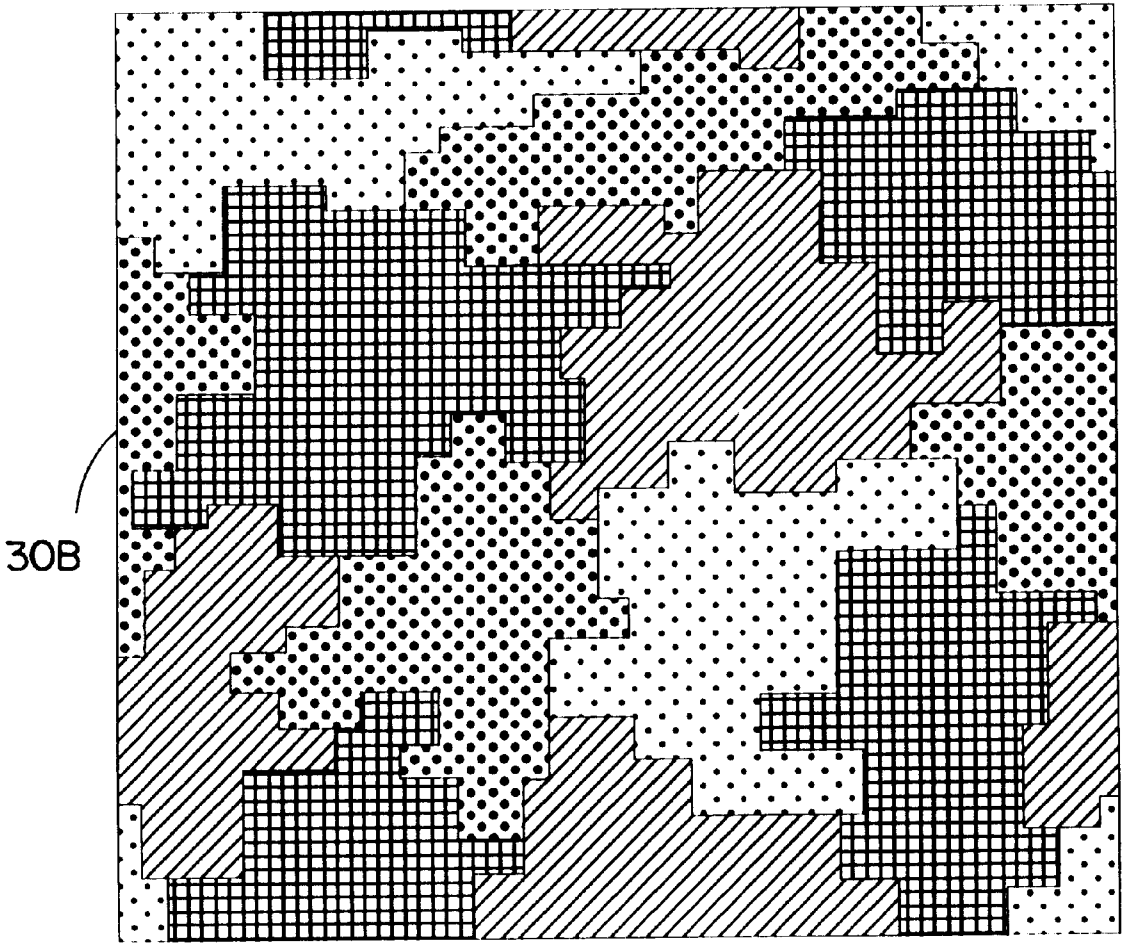
FIG. 2 is a view of a third repeating camouflage pattern for use in conjunction with the garment shown in FIG. 1A.
Figure 3:
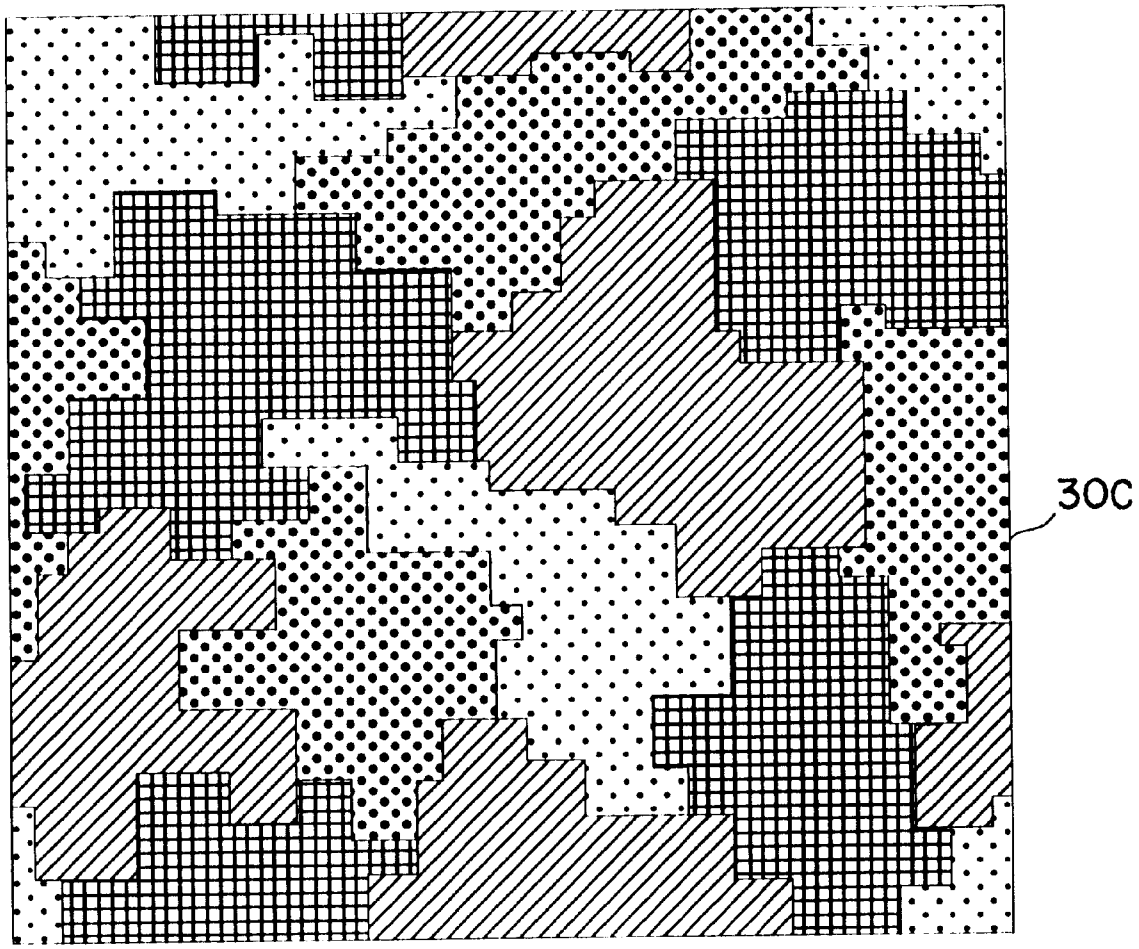
FIG. 3 is a view of a fourth repeating camouflage pattern for use in conjunction with the garment shown in FIG. 1A.
Figure 4:
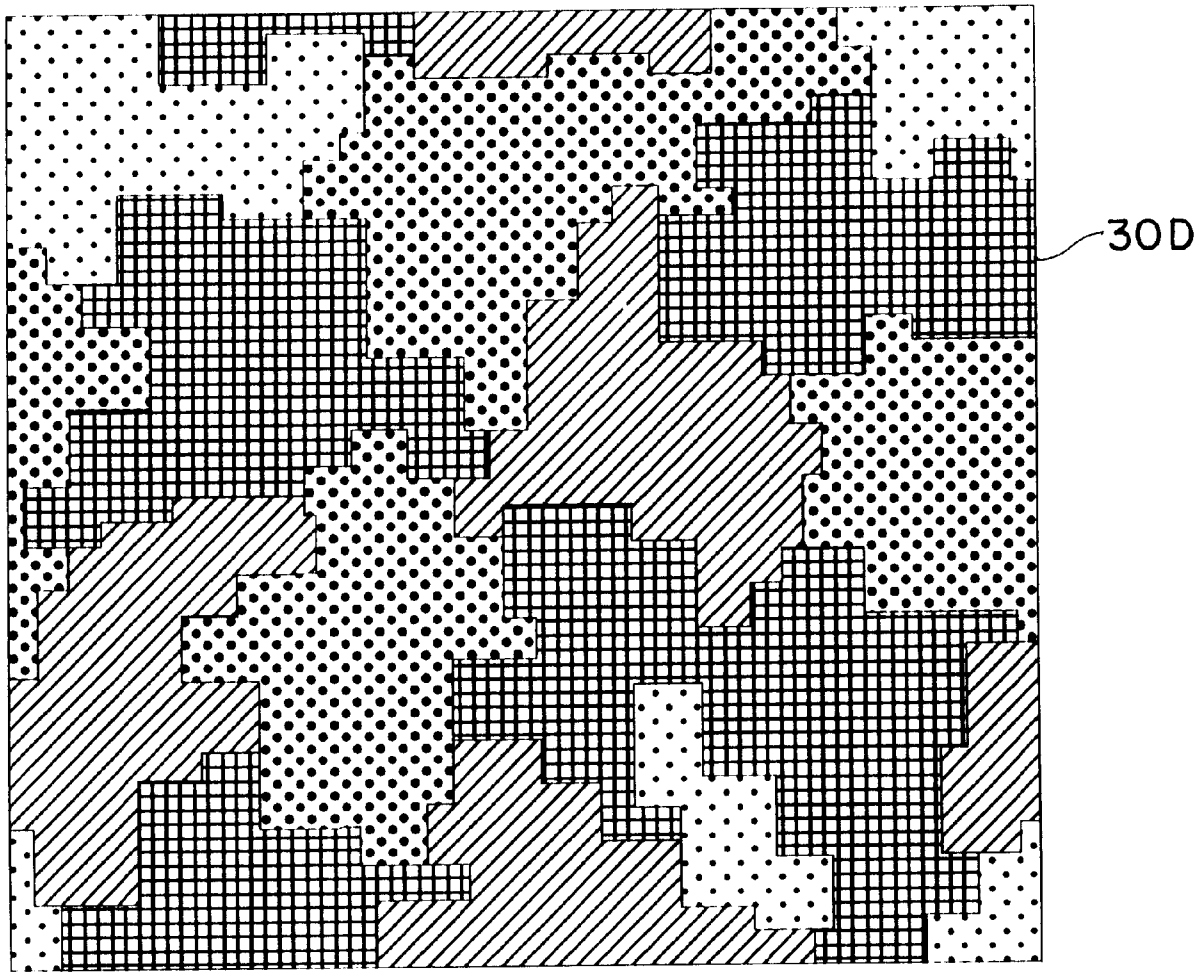
FIG. 4 is a view of a fifth repeating camouflage pattern for use in conjunction with the garment shown in FIG. 1A.

The repeating patterns 30B, 30C and 30D shown in FIGS. 2–4, respectively, have different rectilinear shapes than the embodiments in FIGS. 1A and 1B and may of course be applied to the garment shown in FIG. 1A.

Figure 5:
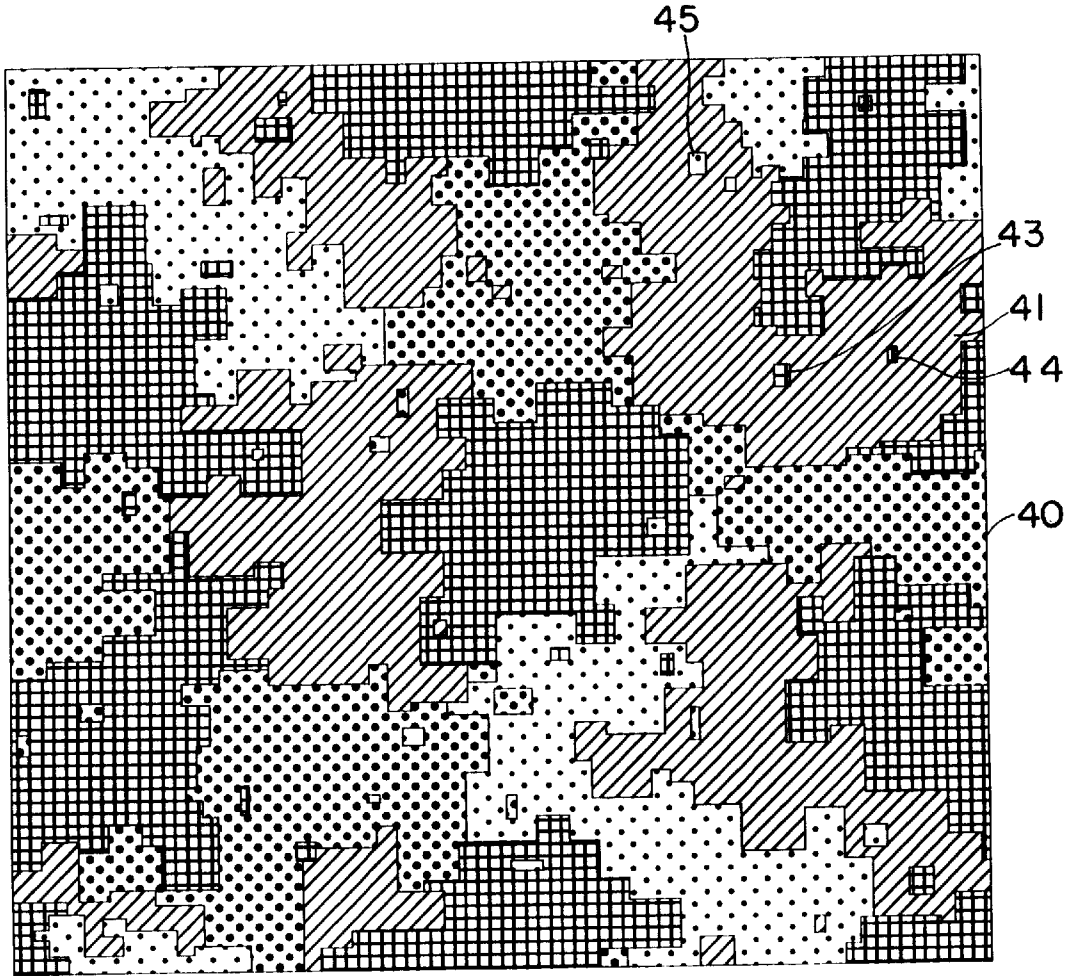
FIG. 5 is a view of a sixth repeating camouflage pattern for use in conjunction with the garment shown in FIG. 1A.

FIG. 5 shows another repeating pattern 40 of camouflage which may be applied to the garment shown in FIG. 1A. This embodiment is similar to those in FIGS. 1A, 1B, 2, 3 and 4 above, except that it also includes enhancement features to enhance the camouflage pattern. These enhancement features constitute rectangular shapes 43,44,45 interspersed in the camouflage pattern, and more specifically in some or all of the rectilinear shapes 41,42. In order to provide the desired enhancement effect, the rectangular shapes 43,44 have a different color than the color of the surrounding rectilinear shape. For example, the color of rectangular shapes 43,44 is darker than the color of rectilinear shape 41. The rectangular shapes can be applied in any manner, even arbitrarily, to the rectilinear shapes with a view toward enhancing the camouflage effect provided by the garment to a hunter. It is noted though that there are users of camouflaged garments aside from hunters, and in fact camouflage is becoming a fashion fabric, and therefore the camouflage pattern in accordance with the invention is not limited to providing camouflage patterns which aid hunters.

Figure 6:
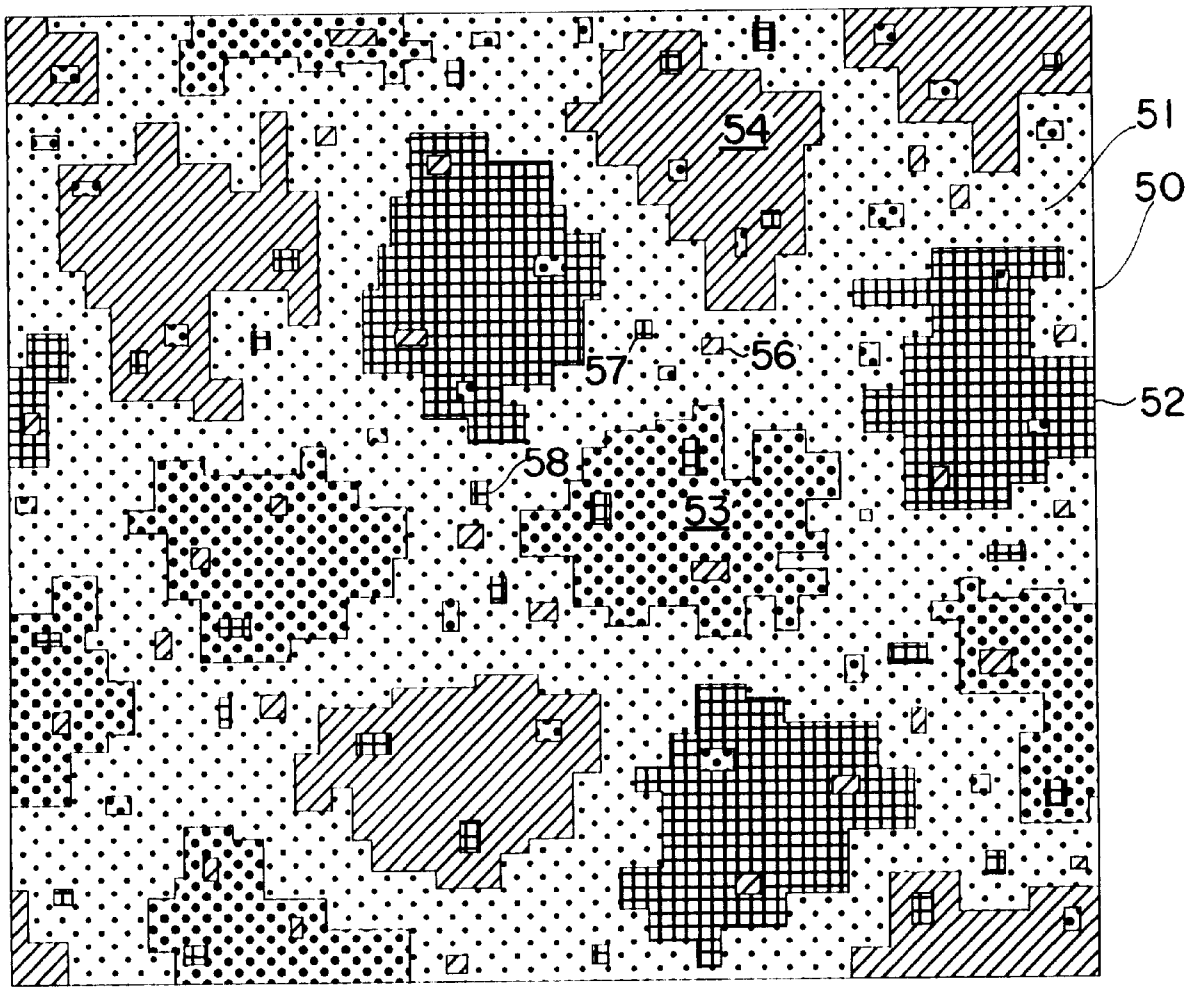
FIG. 6 is a view of a seventh repeating camouflage pattern for use in conjunction with the garment shown in FIG. 1A.

FIG. 6 shows another repeating component 50 of a camouflage pattern in accordance with the invention which may be applied to the garment shown in FIG. 1A. In this embodiment, the repeating pattern 50 can be considered to comprise a background 51 in a single color (beige) onto which a plurality of rectilinear shapes 52,53,54,55 of a different color are overlaid. The background though constitutes a rectilinear shape, albeit one with much more straight sides than the rectilinear shapes 52–55. In a traditional embodiment, the colors of the overlying rectilinear shapes 52,53,54,55 is black, brown and green. Differing from the embodiments in FIGS. 1A,1B and 2–4, the rectilinear shapes 52,53,54,55 do not contact one another but rather the background 51 color is continuous throughout the repeating component. Further, in this embodiment, rectangular shapes 56,57,58 are interspersed about the repeating component, i.e., in the rectilinear shapes as well as in the background. The rectangular shapes 56,57,58 have a color different then the color of the surrounding rectilinear shape, or a color different then the background color if placed onto the background color.

Figure 7:
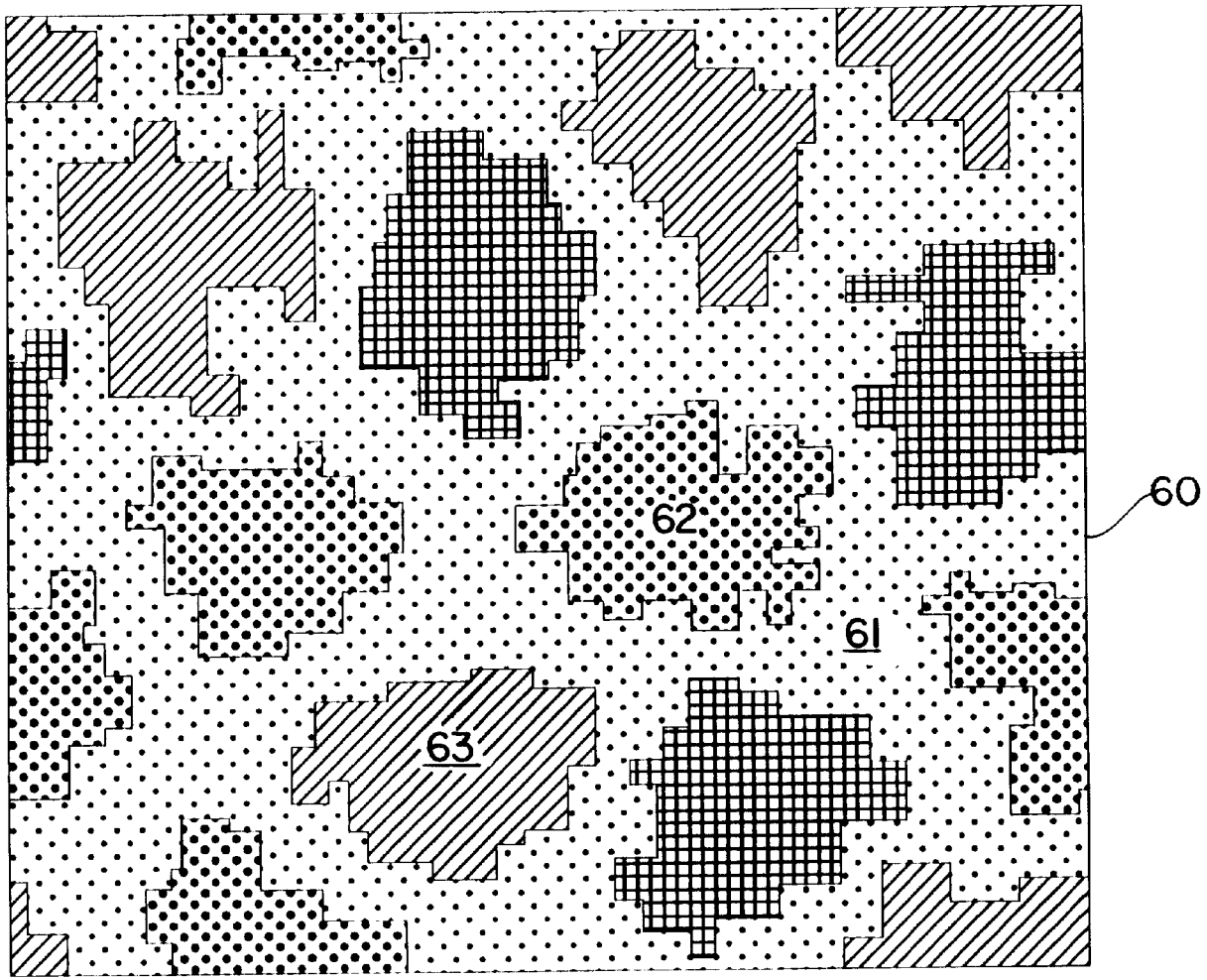
FIG. 7 is a view of an eighth repeating camouflage pattern for use in conjunction with the garment shown in FIG. 1A.

FIG. 7 shows another repeating component 60 of a camouflage pattern in accordance with the invention which may be applied to the garment shown in FIG. 1A, and is similar to the embodiment shown in FIG. 6. In this embodiment, the repeating pattern 60 can be considered to comprise a background 61 in a single color (beige) onto which a plurality of rectilinear shapes 62,63,64 of a different color are overlaid. In a traditional embodiment, the colors of the overlying rectilinear shapes 62,63,64 is black, brown and green. Differing from the embodiments in FIGS. 1A,1B and 2–4, the rectilinear shapes 62,63,64 do not contact one another but rather the background 61 color is continuous throughout the repeating component.

Figure 8:
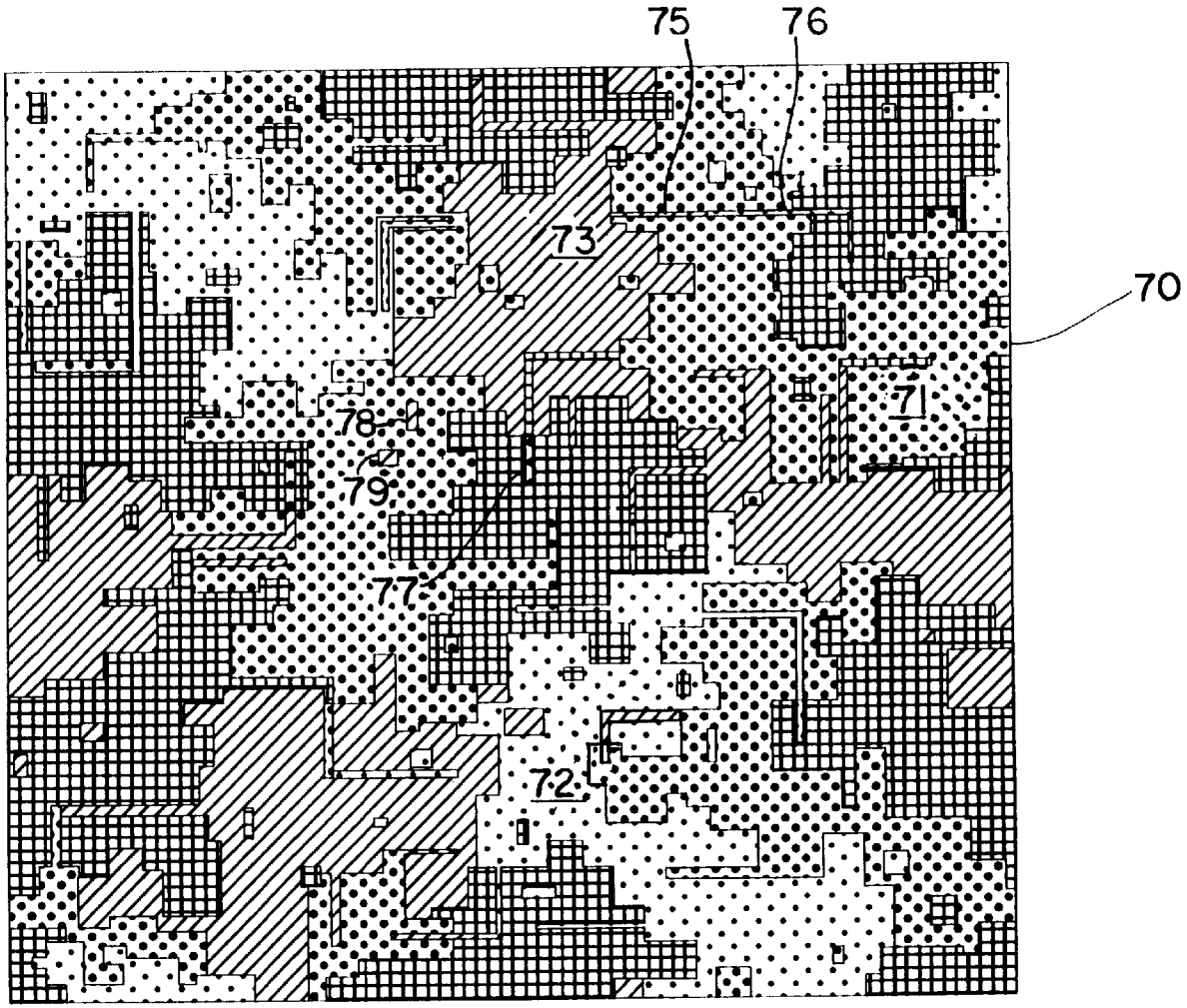
FIG. 8 is a view of a ninth repeating camouflage pattern for use in conjunction with the garment shown in FIG. 1A.

FIG. 8 shows another repeating component 70 of a camouflage pattern in accordance with the invention which may be applied to the garment shown in FIG. 1A. In this embodiment, the repeating pattern 70 can be considered to comprise a plurality of rectilinear shapes 71,72,73, adjacent ones of which have a different color, and optionally includes rectangular shapes 78,79 as in the embodiment shown in FIGS. 5 and 6. In addition, there are long, thin rectangular-shaped projections 75,76,77 which extend from a peripheral edge of some of the rectilinear shapes into the interior of the same rectilinear shape (77, in which case they have a color different than that of the rectilinear shape into which they extend) or into the interior of an adjacent rectilinear shape (75,76, in which case they may have the same color as that of the rectilinear shape from which they extend which is different than the color of the adjacent rectilinear shape into which they extend). These slender projections can be selectively applied to the pattern 70 and colored appropriately to provide an enhanced camouflage effect.

Figure 9:
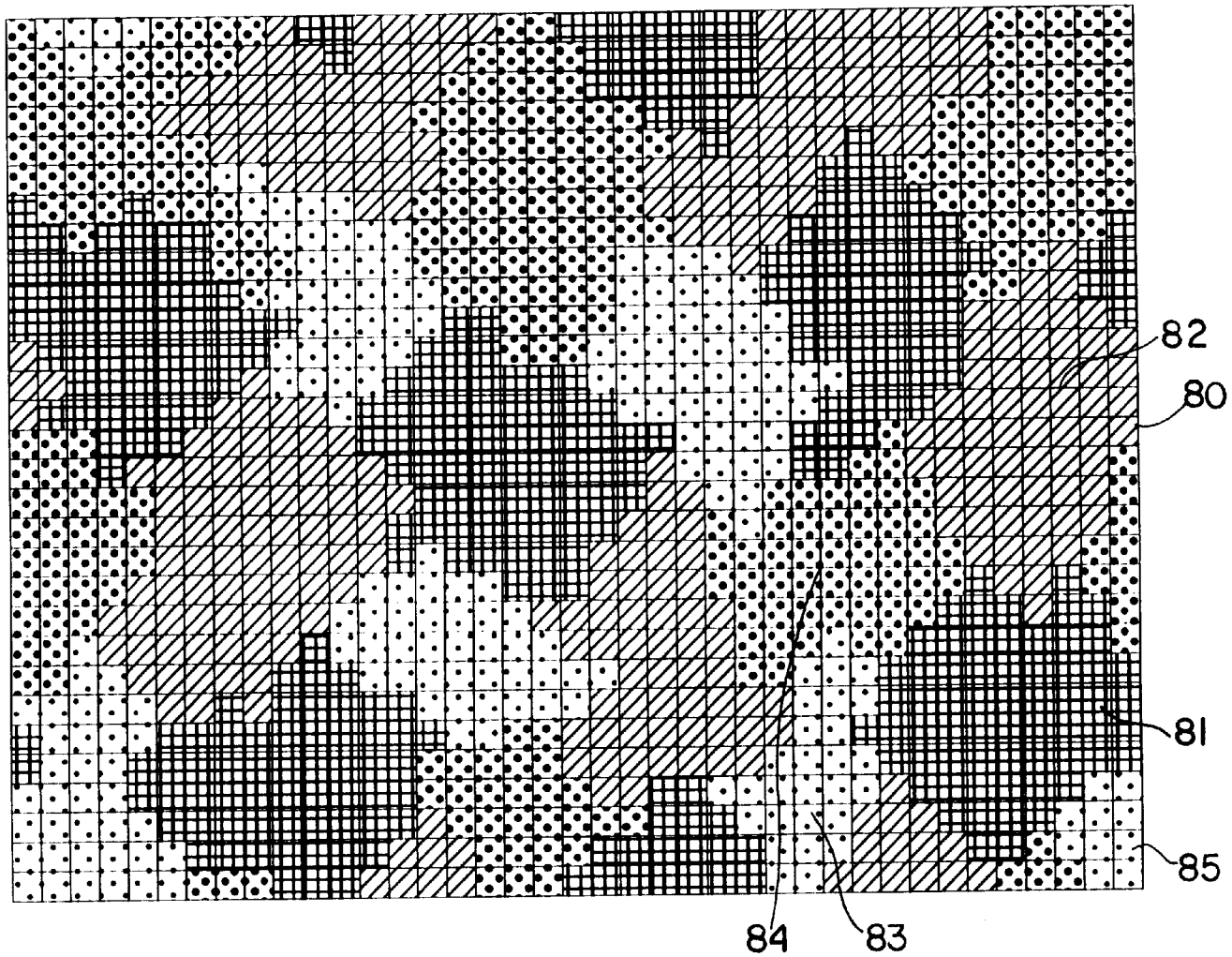
FIG. 9 is a view of a tenth repeating camouflage pattern for use in conjunction with the garment shown in FIG. 1A.

FIG. 9 shows another repeating camouflage pattern 80 in accordance with the invention which may be applied to the garment shown in FIG. 1A. In this embodiment, the repeating pattern 80 can be considered to comprise a plurality of rectilinear shapes 81–84, adjacent ones of which have a different color, and an overlying grid 85 of vertical and horizontal lines superimposed onto the pattern to form a matrix of squares. Each square in the matrix is provided with a single color and such that the rectilinear shapes 81–84 comprise a plurality of adjoining squares. The squares in the grid 85 have only a single color. It should be appreciated that the grid may comprise a different pattern of vertical and horizontal lines and further that the camouflage material may optionally include any of the other camouflage enhancing means disclosed above with respect to FIGS. 5–8.

Figure 9A:
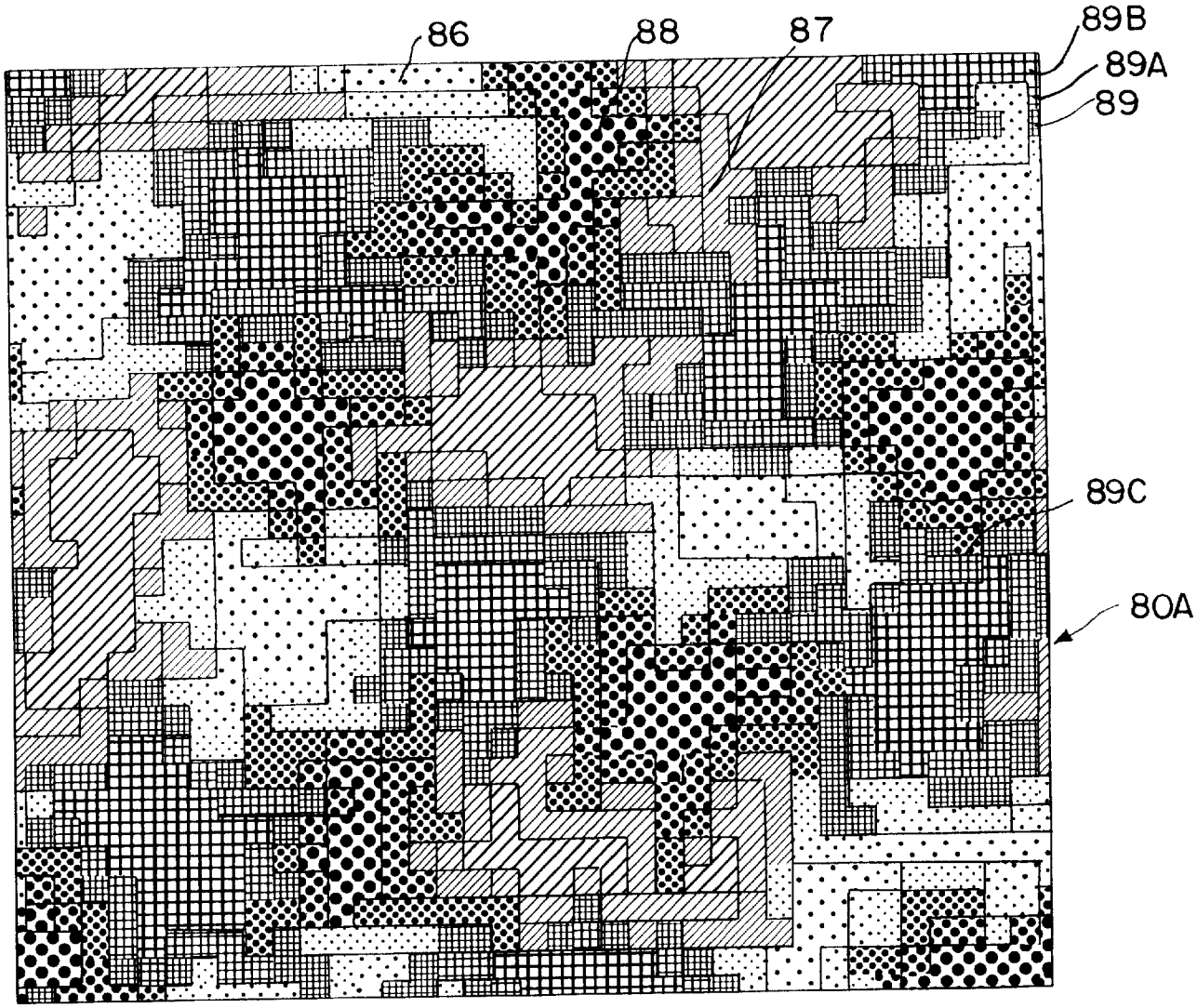
FIG. 9A is a view of an eleventh repeating camouflage pattern for use in conjunction with the garment shown in FIG. 1A.

FIG. 9A shows another repeating camouflage pattern 80A in accordance with the invention which may be applied to the garment shown in FIG. 1A. In this embodiment, the repeating pattern 80A comprises a plurality of rectilinear shapes 86,87,88, adjacent ones of which have a different color, some of which are squares 89,89A,89B,89C, which also constitute a rectilinear shape. With a view toward enhancing the camouflage effect, the square rectilinear shapes can be provided with a color intermediate of the colors of some of the adjoining rectilinear shapes.

Figure 10:
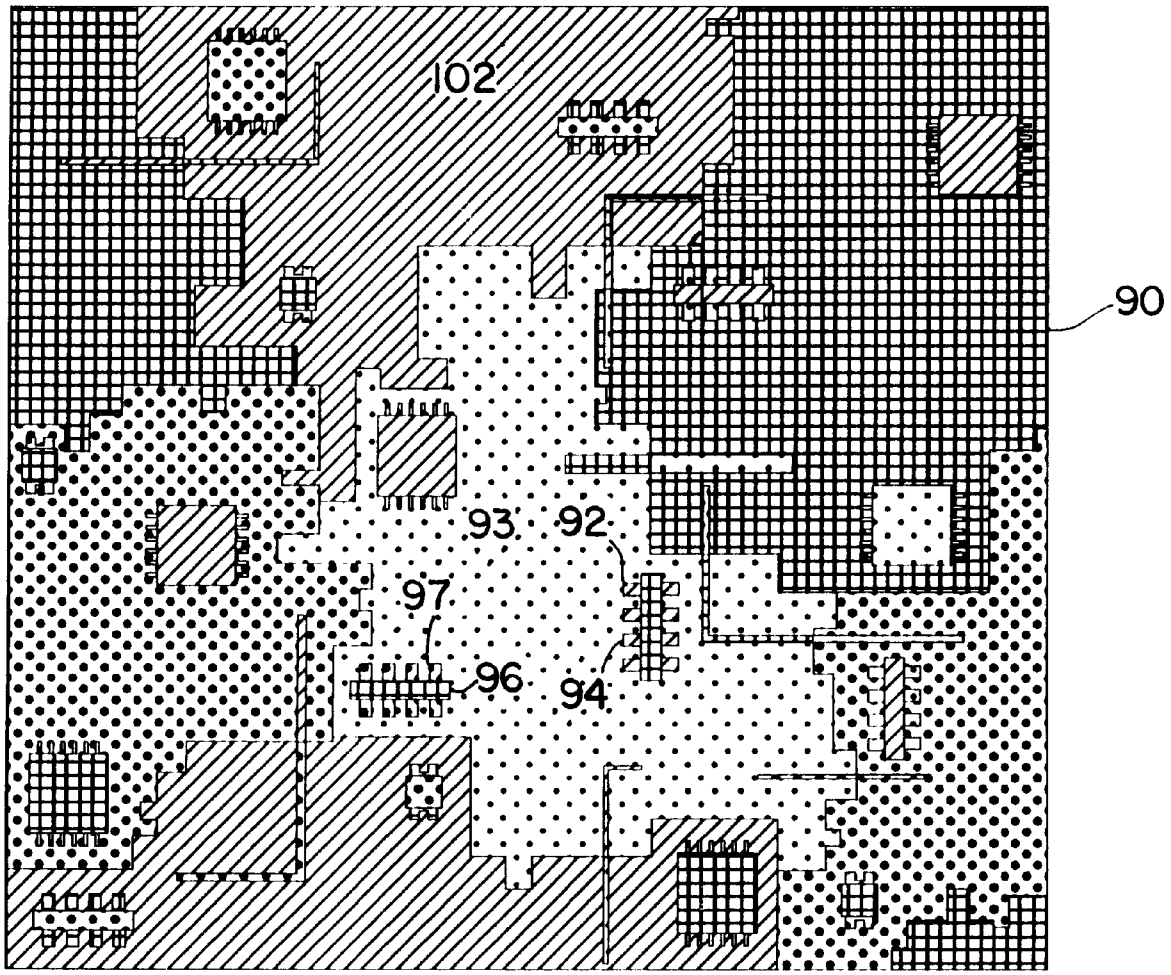
FIG. 10 is a view of a twelfth repeating camouflage pattern for use in conjunction with the garment shown in FIG. 1A.

FIG. 10 shows still another repeating camouflage pattern 90 in accordance with the invention which may be applied to the garment shown in FIG. 1A. In this embodiment, the repeating pattern 90 can be considered to comprise a plurality of rectilinear shapes 91–93, adjacent ones of which have a different color, and several structures 94,96 overlaid onto one or more of the rectilinear shapes 93. The structures 94,96 have a generally rectangular form and projections 95,97 extending outward from two opposed sides of the respective rectangular structures 94,96. These structures 94,96 can, when the colors of the rectilinear shapes 91,92,93 are appropriately selected and the colors and arrangement of the structures 94,96 and associated projections 95,97, respectively, are appropriately selected, provided an enhanced camouflage effect.

Figure 11:
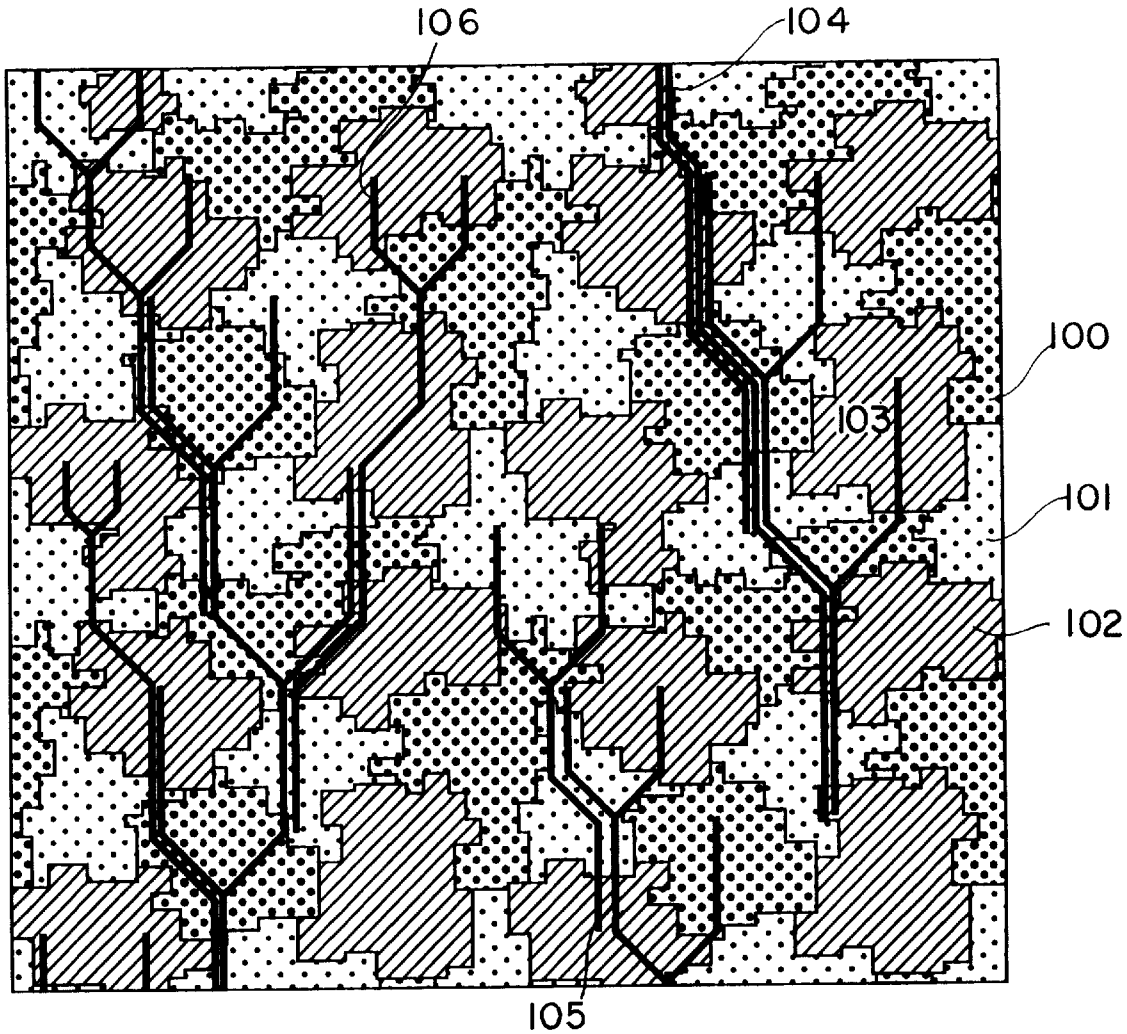
FIG. 11 is a view of a thirteenth repeating camouflage pattern for use in conjunction with the garment shown in FIG. 1A.

FIG. 11 shows yet another repeating camouflage pattern 100 in accordance with the invention which may be applied to the garment shown in FIG. 1A. In this embodiment, the repeating pattern 100 can be considered to comprise a plurality of rectilinear shapes 101–103, adjacent ones of which have a different color (as in any of FIGS. 1A,2B and 2–4), and one or more overlying branched line structures 104,105,106 which is similar in appearance to circuit wirings of a printed circuit board as well as similar to the branching structure of certain trees. Each branch line structure 104,105,106 is composed of straight lines and "Y"-shaped connections between certain straight lines to thereby form a branch tree of sorts. This branch line structure may be used in connection with any of the camouflage patterns described herein in order to enhance the camouflage effect.

Figure 12:
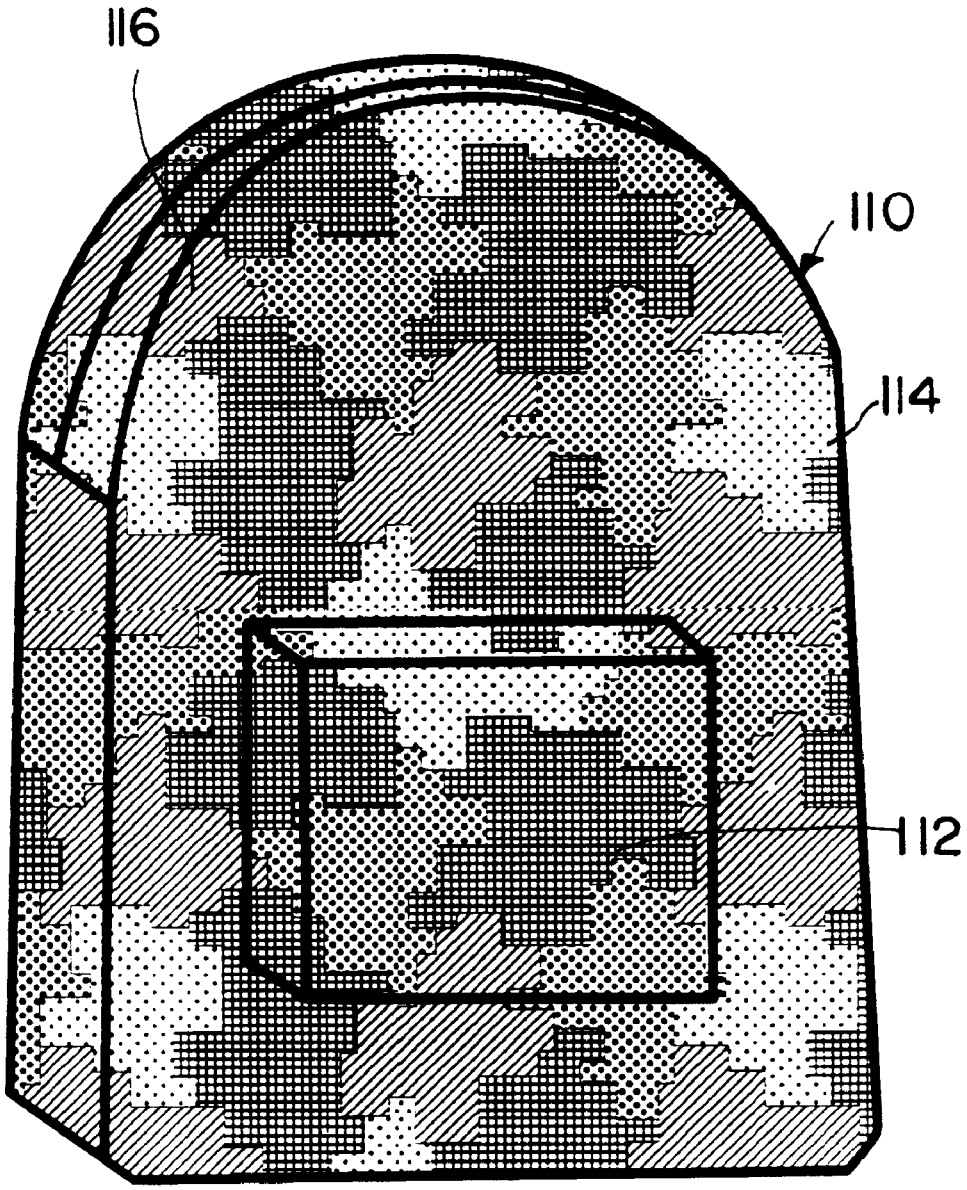
FIG. 12 is a view of a backpack made of camouflage material including the repeating pattern shown on the garment in FIG. 1A.
Figure 13:
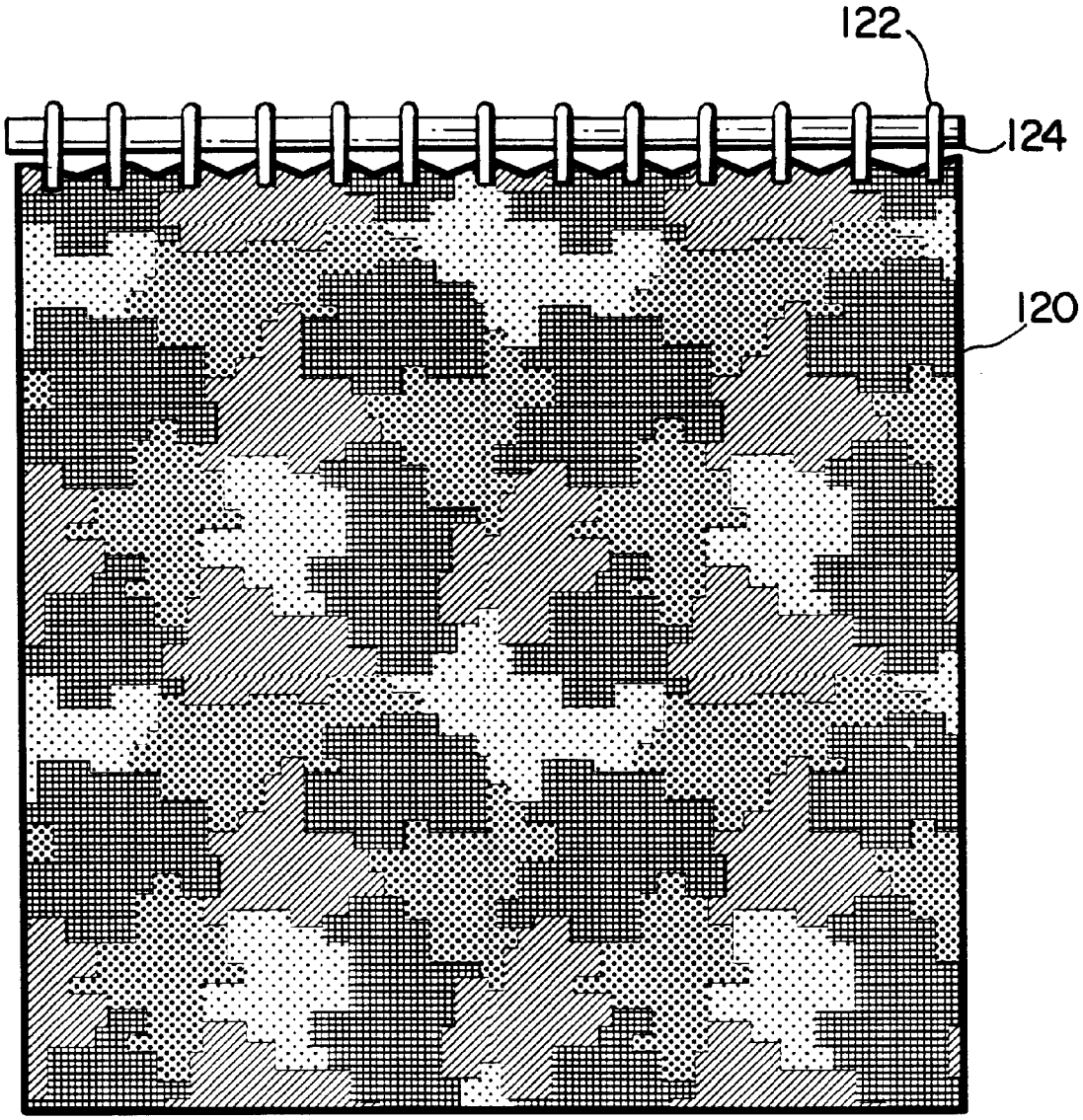
FIG. 13 is a view of a shower curtain made of camouflage material including the repeating pattern shown on the garment in FIG. 1A.
Figure 14:
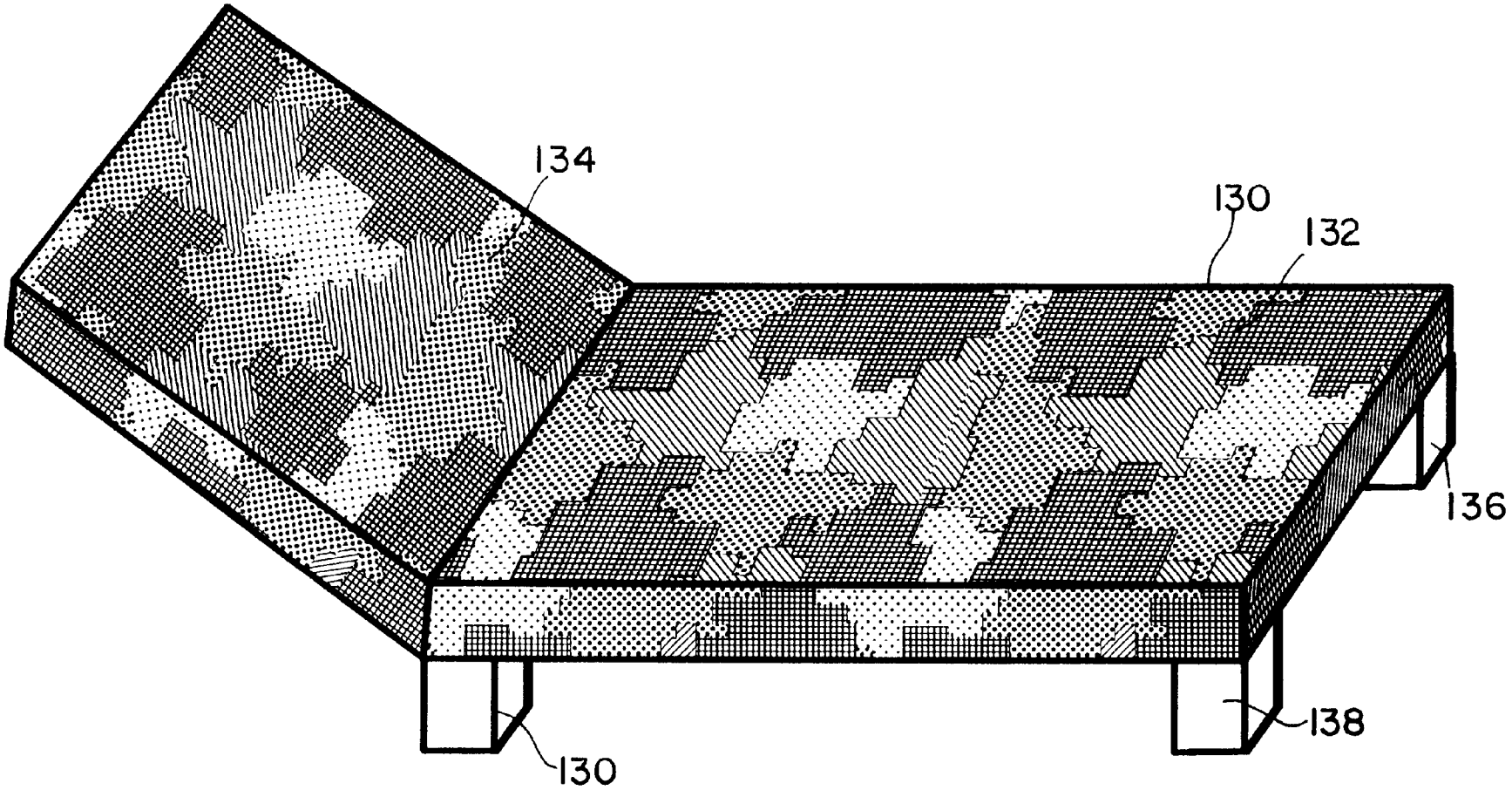
FIG. 14 is a view of a lawn chair made of camouflage material including the repeating pattern shown on the garment in FIG. 1A.

Although the use of the camouflage patterns described above was specified in connection with the garment shown in FIG. 1A, e.g., for a hunter since hunters probably use more camouflage items than an average persons, it should be unequivocally stated that the camouflage patterns herein are not limited to application to a garment worn by a hunter. Rather, as shown in FIG. 12, the camouflage pattern of FIG. 1A may be applied to a backpack 110 having a front section 114 with a pouch 112 formed thereon. A closure mechanism such as a zipper 116 enables access into the interior of the backpack 110. In a similar vein, the camouflage pattern of FIG. 1A can be applied to a shower curtain 120 as shown in FIG. 13 which includes attachment means such as hooks 122 for attachment to a shower rod 124 or to a lawn chair 130 as shown in FIG. 14. The lawn chair 130 includes a leg portion 132, a back portion 134 and supporting legs 136,138 connected to the leg portion 132. Thus, the use of the camouflage material disclosed herein is not expressly limited to garments although probably the most beneficial use of a camouflage item is for garments worn specifically by hunters.

The examples provided above are not meant to be exclusive. Many other variations of the present invention would be obvious to those skilled in the art, and are contemplated to be within the scope of the appended claims. For example, the camouflage patterns disclosed herein can be applied to any article base, flexible base material or flexible sheet material, and used for such items as a hunting blind and hunting equipment.

I claim:

1. A clothing garment adaptable for camouflage effect, comprising a garment material conformed to fit at least a portion of the human body, said garment material having a base color, an exposed surface of said garment material having a plurality of rectilinear shapes formed such that at least one additional rectilinear shape is also formed by the base color, each of said rectilinear shapes and said at least one additional rectilinear shape being formed by a plurality of straight sides, pairs of adjacent ones of said straight sides in each of said rectilinear shapes and said at least one additional rectilinear shape being perpendicular to one another, and at least one of a plurality of dyes being applied to each of said rectilinear shapes such that adjacent ones of said rectilinear shapes have a different color, the dyes providing color to said rectilinear shapes different than the base color.

2. The garment of claim 1, wherein said garment material comprises a torso portion, sleeves extending downward from a top, side of said torso portion and a neck portion extending from an upper edge of said torso portion.

3. The garment of claim 1, wherein each of said rectilinear shapes has at least six straight sides and at least one interior angle between 180° and 360°.

4. The garment of claim 1, wherein said rectilinear shapes are formed such that opposed straight sides are substantially parallel to one another.

5. The garment of claim 1, further comprising camouflage enhancement means arranged in connection with the garment material for providing additional color contrast to thereby enhance the camouflage effect of the garment material, said enhancement means comprising a dye applied to only a portion of at least one of said rectilinear shapes which is different than the dye applied to a remaining portion of said rectilinear shape.

6. The garment of claim 5, wherein said enhancement means comprise rectangular shapes arranged within at least one of said rectilinear shapes and having a color different than said at least one rectilinear shape surrounding said rectangular shapes.

7. The garment of claim 5, wherein said enhancements means comprise slender projections extending from edges of at least one of said rectilinear shapes into said at least one rectilinear shape or into an adjacent one of said rectilinear shapes.

8. The garment of claim 7, wherein said projections extend into said at least one rectilinear shape and have a color different than the color of said at least one rectilinear shape.

9. The garment of claim 7, wherein said projections extend into the adjacent one of said rectilinear shapes and have a color the same as said at least one rectilinear shape.

10. The garment of claim 5, wherein said enhancement means comprise rectangular shapes arranged within at least one of said rectilinear shapes, said rectangular shapes having projections extending from a pair of opposed sides, said rectangular shapes and said projections having a color different than the color of said at least one rectilinear shape.

11. The garment of claim 1, wherein said rectilinear shapes are arranged to form a repeating pattern.

12. The garment of claim 1, wherein one of said rectilinear shape constitutes a background of the garment material and other of said rectilinear shapes are superimposed on said one of said rectilinear shapes, have a different color than said one of said rectilinear shapes and do not contact each other such that a portion of said one of said rectilinear shapes is interposed between each adjacent pair of rectilinear shapes.

13. The garment of claim 12, further comprising camouflage enhancement means arranged in connection with the garment material for providing additional color contrast to thereby enhance the camouflage effect of the camouflage material, said enhancement means comprising a dye applied onto at least one rectangular portion within at least one of said rectilinear shapes and having a color different than the color of the dye being applied onto said at least one rectilinear shape.

14. The garment of claim 1, further comprising a dye of a color different than the dyes being applied to said rectilinear shapes and which is applied to the garment material to form a grid of bi-directional lines superimposed on the garment material.

15. The garment of claim 5, wherein said enhancement means comprise a branch line structure extending through at least one of said rectilinear shapes having a color different than the color of said at least one rectilinear shape.

16. The garment of claim 1, wherein at least a portion of said rectilinear shapes are square.

17. A method for manufacturing a clothing garment adaptable for camouflage effect, comprising the steps of:

applying a repeating pattern of a single square containing a plurality of rectilinear shapes to an exposed surface of a garment material having a base color such that a left side of the square adjoins a right side of another square in the same orientation, a right side of the square adjoins a left said of another square in the same orientation, a top side of the square adjoins a bottom side of another square in the same orientation and a bottom side of the square adjoins a top side of another square in the same orientation, forming each of said rectilinear shapes by a plurality of straight sides such that at least one additional rectilinear shape is also formed by the base color, pairs of adjacent ones of said straight sides in each of said rectilinear shapes and said at least one additional rectilinear shape being perpendicular to one another, and applying at least one of a plurality of dyes to each of said rectilinear shapes such that adjacent ones of said rectilinear shapes having a different color, the dyes providing color to said rectilinear shapes different than the base color.

18. The method of claim 17, further comprising the step of: providing additional color contrast to the garment material to thereby enhance the camouflage effect of the garment material applying a dye to only a portion of each of said rectilinear shapes which is different than the dye applied to a remaining portion of said rectilinear shape.

19. A clothing garment adaptable for camouflage effect, comprising a garment material conformed to fit at least a portion of the human body, an exposed surface of said garment material having a plurality of rectilinear shapes, each of said rectilinear shapes being formed by a plurality of straight sides, pairs of adjacent ones of said straight sides in each of said rectilinear shapes being perpendicular to one another, one of said rectilinear shape constituting a background of the garment material and other of said rectilinear shapes being superimposed on said one of said rectilinear shapes, having a different color than said one of said rectilinear shapes and not being in contact with each other such that a portion of said one of said rectilinear shapes is interposed between each adjacent pair of rectilinear shapes, and at least one of a plurality of dyes being applied to each of said rectilinear shapes such that adjacent ones of said rectilinear shapes have a different color.

20. The garment of claim 19, further comprising camouflage enhancement means arranged in connection with the garment material for providing additional color contrast to thereby enhance the camouflage effect of the camouflage material, said enhancement means comprising a dye applied to only a portion of each of said rectilinear shapes which is different than the dye applied to a remaining portion of said rectilinear shape.

* * * * *